US011988476B2

(12) United States Patent
Noonan

(10) Patent No.: US 11,988,476 B2
(45) **Date of Patent: *May 21, 2024**

(54) EXPANSION CHAMBER ASSEMBLY AND A METHOD OF MANUFACTURING THE SAME

(71) Applicant: F.M. Products Inc, Boise, ID (US)

(72) Inventor: Paul T. Noonan, Boise, ID (US)

(73) Assignee: F.M. Products Inc, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/590,708

(22) Filed: Feb. 1, 2022

(65) Prior Publication Data

US 2023/0003478 A1 Jan. 5, 2023

Related U.S. Application Data

(63) Continuation of application No. 15/987,833, filed on May 23, 2018, now Pat. No. 11,268,776.

(60) Provisional application No. 62/510,707, filed on May 24, 2017.

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/30; F41A 21/28
See application file for complete search history.

(56) References Cited

U.S. PATENT DOCUMENTS

| | | | | |
|---|---|---|---|---|
| 4,307,652 | A * | 12/1981 | Witt | F41A 21/36 89/14.3 |
| 8,025,003 | B1 * | 9/2011 | Saur | F41A 21/24 42/76.01 |
| 8,261,651 | B2 * | 9/2012 | Casas Salva | F41A 21/30 89/14.4 |
| 8,939,057 | B1 * | 1/2015 | Edsall | F41A 21/30 89/14.05 |
| 8,997,621 | B1 * | 4/2015 | Dater | F41A 21/325 89/14.3 |
| 9,102,010 | B2 * | 8/2015 | Wilson | F41A 21/36 |
| 9,500,427 | B1 * | 11/2016 | Larue | F41A 21/30 |
| 9,658,010 | B1 * | 5/2017 | Oglesby | F41C 23/16 |
| 9,677,839 | B1 * | 6/2017 | Phoenix | F41A 21/30 |
| 9,982,959 | B2 * | 5/2018 | Washburn, III | F41A 21/30 |
| 10,107,581 | B2 * | 10/2018 | Garst | F41A 21/30 |
| 10,126,084 | B1 * | 11/2018 | Oglesby | F41A 21/30 |
| 10,234,230 | B1 * | 3/2019 | Oglesby | F41A 21/325 |
| 10,337,819 | B1 * | 7/2019 | Stark | F41A 21/30 |
| 10,386,146 | B2 * | 8/2019 | Spector | F41G 11/003 |
| 10,502,513 | B2 * | 12/2019 | Ellison | F41A 21/30 |
| 11,268,776 | B1 * | 3/2022 | Noonan | F41A 21/30 |

(Continued)

*Primary Examiner* — Michelle Clement

(57) ABSTRACT

A expansion chamber assembly for a firearm is disclosed. The expansion chamber contains an outer tube containing a front end and a rear end, a front cap coupled with the outer tube at the front end, a rear cap coupled with the outer tube at the rear end, an inner tube retained within the outer tube by the front cap and the rear cap, wherein the inner cap contains one or more through apertures to allow expanding gasses to move from the inner tube into the outer tube, and one or more exit apertures to allow expensing gases to exit the expansion chamber assembly.

3 Claims, 29 Drawing Sheets

(56) References Cited

U.S. PATENT DOCUMENTS

2003/0010187 A1* 1/2003 Muirhead ..... F28F 1/20 89/14.1
2003/0145718 A1* 8/2003 Hausken ..... F41A 21/30 89/14.4
2011/0186377 A1* 8/2011 Kline ..... F41A 21/30 181/223
2012/0011757 A1* 1/2012 Yost ..... F41A 21/28 42/79
2012/0152649 A1* 6/2012 Larue ..... F41A 21/36 181/223
2013/0180797 A1* 7/2013 Dueck ..... F41A 21/325 181/296
2013/0319790 A1* 12/2013 Bladen ..... F41A 21/30 181/223
2014/0059913 A1* 3/2014 Diamond ..... F41A 21/30 42/90
2014/0224574 A1* 8/2014 Latka ..... F41A 21/30 181/223
2014/0231168 A1* 8/2014 Dueck ..... F41A 21/325 181/223
2014/0262605 A1* 9/2014 Washburn, III ..... F41A 21/30 264/294
2015/0001001 A1* 1/2015 Wilson ..... F41A 21/36 219/76.1
2015/0090105 A1* 4/2015 Pace ..... F41A 21/30 89/14.4
2015/0136519 A1* 5/2015 Moore ..... F41A 21/30 181/223
2015/0241159 A1* 8/2015 Michal ..... F41A 21/30 89/14.4
2015/0260472 A1* 9/2015 Smith ..... F41A 21/30 89/14.2
2015/0285575 A1* 10/2015 Sclafani ..... F41A 21/30 29/402.08
2015/0308776 A1* 10/2015 Smith ..... F41A 21/34 89/14.2
2015/0354422 A1* 12/2015 Liskey ..... F41A 21/30 89/14.4
2015/0377577 A1* 12/2015 Pappas ..... F41A 21/34 89/14.2
2016/0003570 A1* 1/2016 Tonkin ..... F41A 21/30 89/14.4
2016/0010935 A1* 1/2016 Clarke ..... F41A 21/28 29/896.2
2016/0018179 A1* 1/2016 Morris ..... F41A 21/30 181/223
2016/0054086 A1* 2/2016 Westlake ..... F41A 21/30 89/14.4
2016/0061551 A1* 3/2016 Petersen ..... F41A 21/30 89/14.4
2016/0123689 A1* 5/2016 Maeda ..... F41A 21/30 89/14.3
2016/0161203 A1* 6/2016 Wilson ..... B23K 35/0255 89/14.3
2016/0209149 A1* 7/2016 Fischer ..... F41A 21/30
2017/0199002 A1* 7/2017 Hwang ..... F41A 21/34
2017/0205175 A1* 7/2017 Garst ..... F41A 21/30
2017/0299291 A1* 10/2017 Spector ..... F41A 5/26
2017/0299313 A1* 10/2017 Adamson, Jr. ..... F41A 21/30
2018/0023912 A1* 1/2018 Cudazzo ..... F41A 17/72 89/136
2018/0031346 A1* 2/2018 Washburn, III ..... F41A 21/30
2018/0038663 A1* 2/2018 Larue ..... F41A 21/30
2018/0058789 A1* 3/2018 Dorne ..... F41A 21/30
2018/0202744 A1* 7/2018 De Sousa ..... F41A 21/34
2018/0252489 A1* 9/2018 Parker ..... F41A 21/30
2018/0321008 A1* 11/2018 Barney ..... F41A 21/30
2019/0017767 A1* 1/2019 Griffis ..... F41A 21/30
2019/0017768 A1* 1/2019 Thomas ..... F41A 21/30
2019/0033030 A1* 1/2019 Belykov ..... F41A 21/30
2019/0128632 A1* 5/2019 Christandl ..... F41A 21/30
2019/0249942 A1* 8/2019 Dunham ..... F41A 21/30
2020/0025495 A1* 1/2020 Petersen ..... F42B 39/20
2020/0049443 A1* 2/2020 McMillan ..... F41A 21/28
2020/0072571 A1* 3/2020 Washburn, III ..... B22F 7/004
2020/0141679 A1* 5/2020 Garst ..... F41A 21/30
2020/0166304 A1* 5/2020 Martin ..... F41A 21/28
2020/0173751 A1* 6/2020 Dorne ..... F41A 21/30
2020/0232740 A1* 7/2020 Honigmann ..... F41A 21/30

* cited by examiner

EXPANSION CHAMBER ASSEMBLY AND A METHOD OF MANUFACTURING THE SAME

CROSS REFERENCE TO RELATED APPLICATIONS

This application is a continuation of U.S. patent application Ser. No. 15/987,833 titled "EXPANSION CHAMBER ASSEMBLY AND A METHOD OF MANUFACTURING THE SAME" filed May 23, 2018, which is incorporated herein by reference in its entirety. The U.S. patent application Ser. No. 15/987,833 claims the benefit of U.S. Provisional Application No. 62/510,707, filed on May 24, 2017, which is incorporated herein by reference in its entirety.

FIELD

The present invention relates to a firearm. More particularly, the present invention relates to an expansion chamber assembly for a firearm.

BACKGROUND

Firing a bullet from a firearm creates a loud noise. The firearm silencers known in the art have various baffles and intermediate spacers that attempt to decrease the noise level created by the firearm when firing a bullet. These silencers are heavy, use lots of different types of parts and/or are difficult to assemble thereby making them expensive to manufacture and quite costly for ultimate consumers, in addition, many prior art silencers do not significantly reduce muzzle flash and/or recoil generated by the firearm when firing the bullet. Therefore, a need exists for a way to reduce noise levels, flash and/or recoil when firing a firearm.

BRIEF DESCRIPTION OF THE FIGURES

FIG. 1*b* depicts an exploded view of the expansion chamber assembly shown in FIG. 1*a*.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1A:
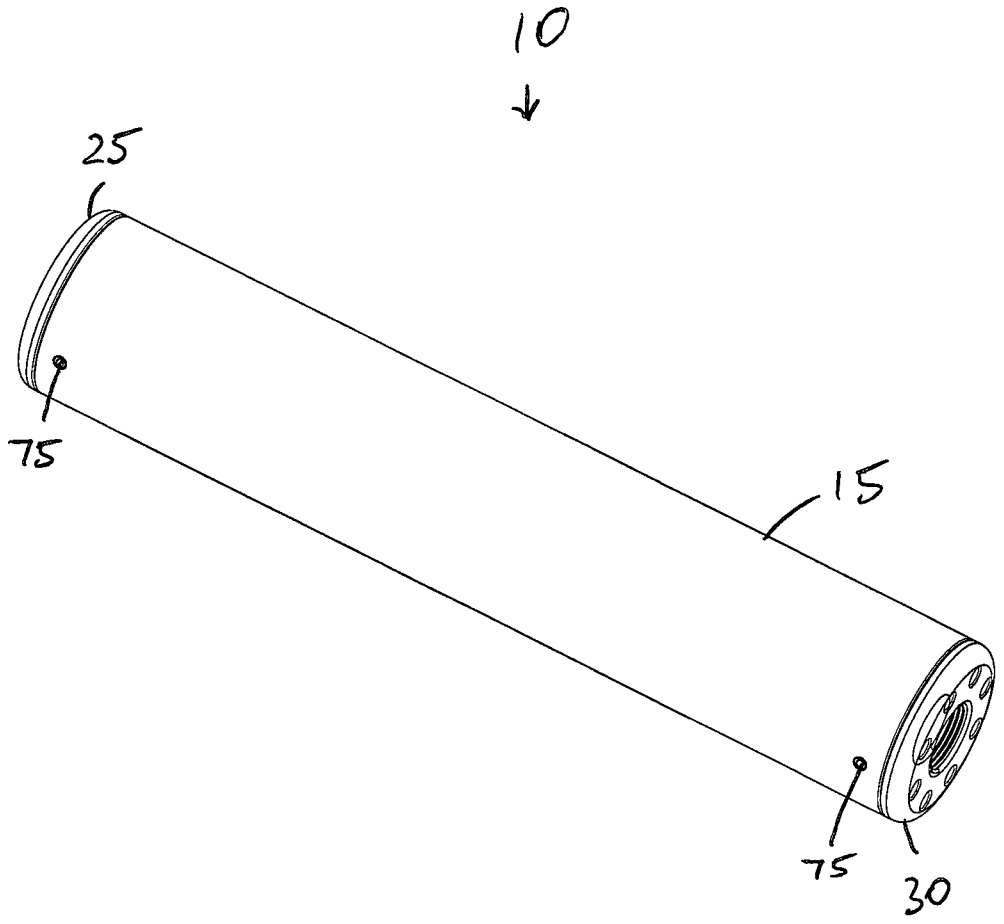
FIG. 1*a* depicts expansion chamber assembly according to some embodiments presently disclosed.
Figure 16:
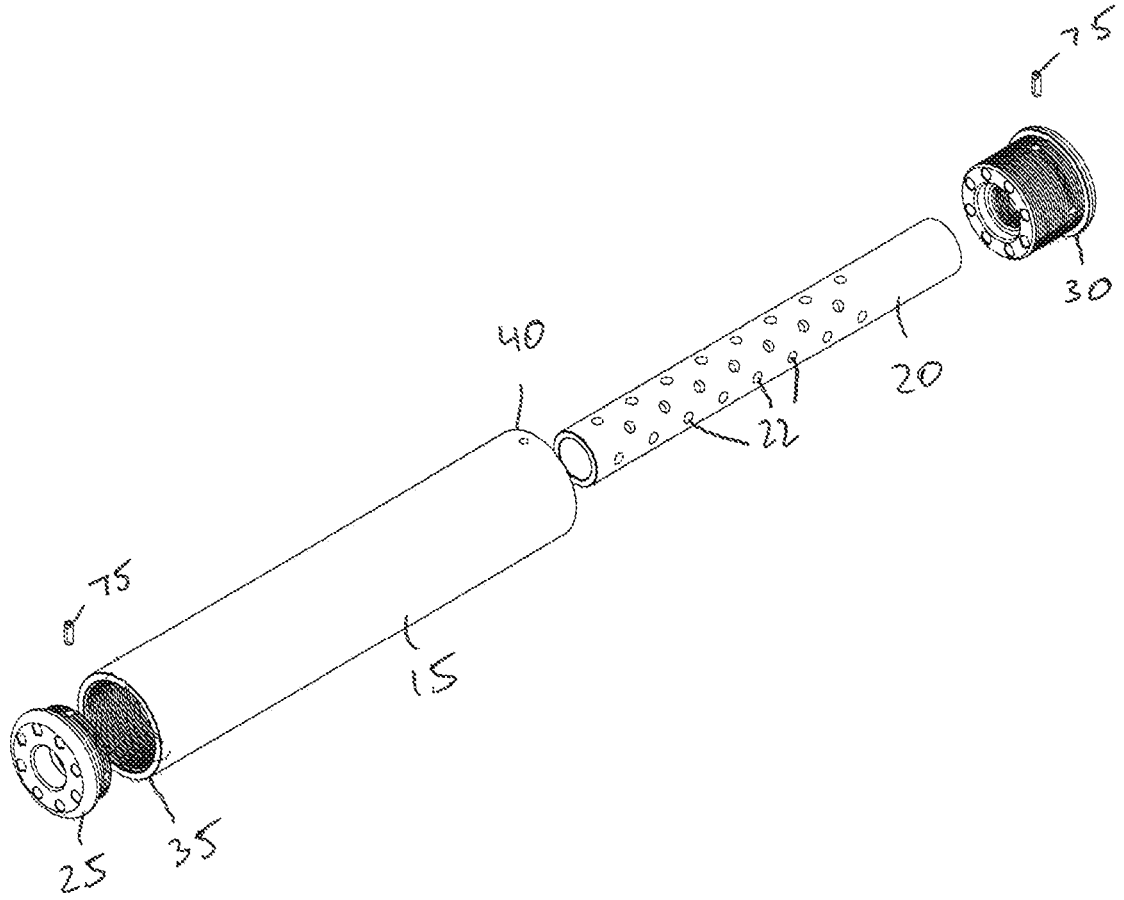
Figure 2:
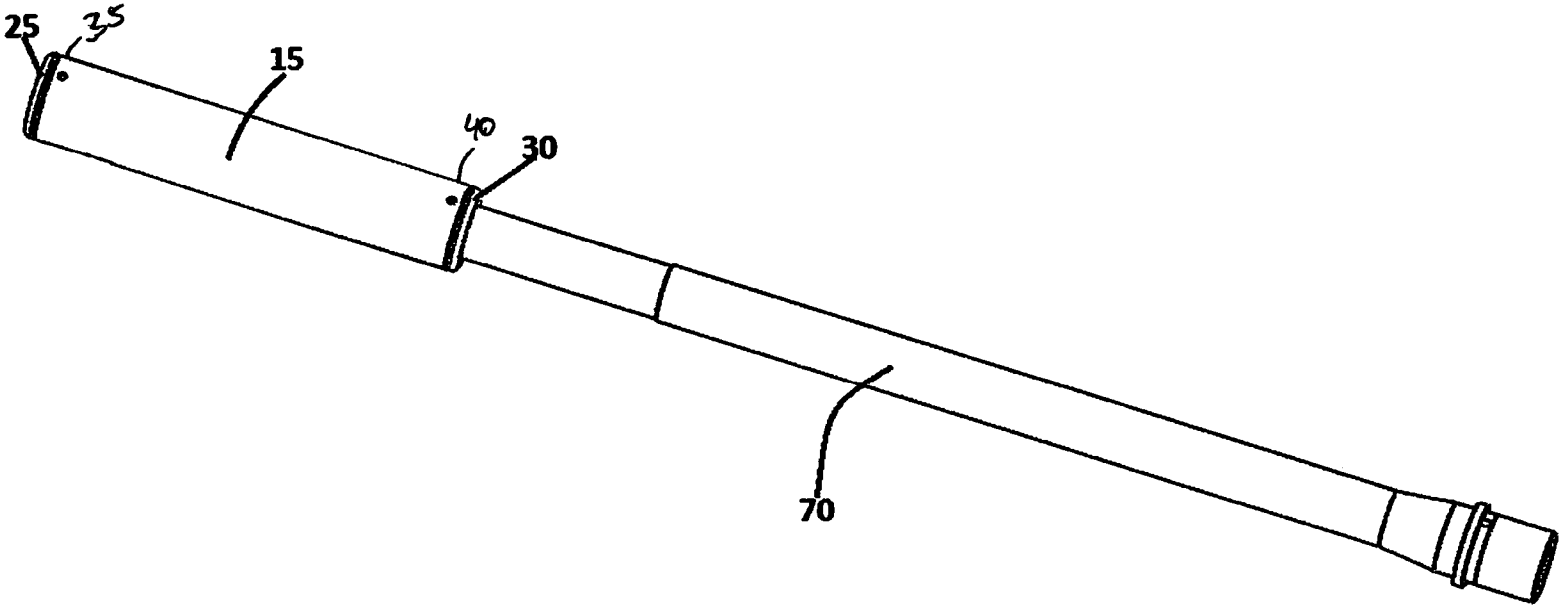
FIG. 2 depicts the expansion chamber assembly shown in FIG. 1*a* coupled with a barrel of a firearm.

Referring to FIGS. 1*a-b*, an expansion chamber assembly 10 is shown according to some embodiments presently disclosed. According to some embodiments, the expansion chamber assembly 10 comprises an outer tube 15, an inner tube 20, a front cap 25, and a rear cap 30. According to some embodiments, the expansion chamber assembly 10 is coupled with an exit end of a barrel 70 (shown in FIG. 2) from a firearm. Although the barrel 70 is shown as a rifle barrel, it is to be understood that the expansion chamber assembly 10 can be coupled with a rifle barrel or a handgun barrel. It is to be further understood that the expansion chamber assembly 10 is removably coupled with the barrel 70 or the expansion chamber assembly 10 integral with the barrel 70. According to some embodiments, the expansion chamber assembly 10 is welded with the exit end of the barrel 70. According to some embodiments, the expansion chamber assembly 10 may be pinned with the exit end of the barrel 70.

According to some embodiments, the outer tube 15 comprises a first diameter and the inner tube 20 comprises a second diameter, wherein the first diameter is larger than the second diameter. According to some embodiments, the outer tube 15 has a diameter sufficient to accommodate the inner tube 20. According to some embodiments, the outer tube 15 and the inner tube 20 are hollow cylinders wherein the outer tube 15 has a diameter sufficient to accommodate the inner tube 20.

Figure 3A:
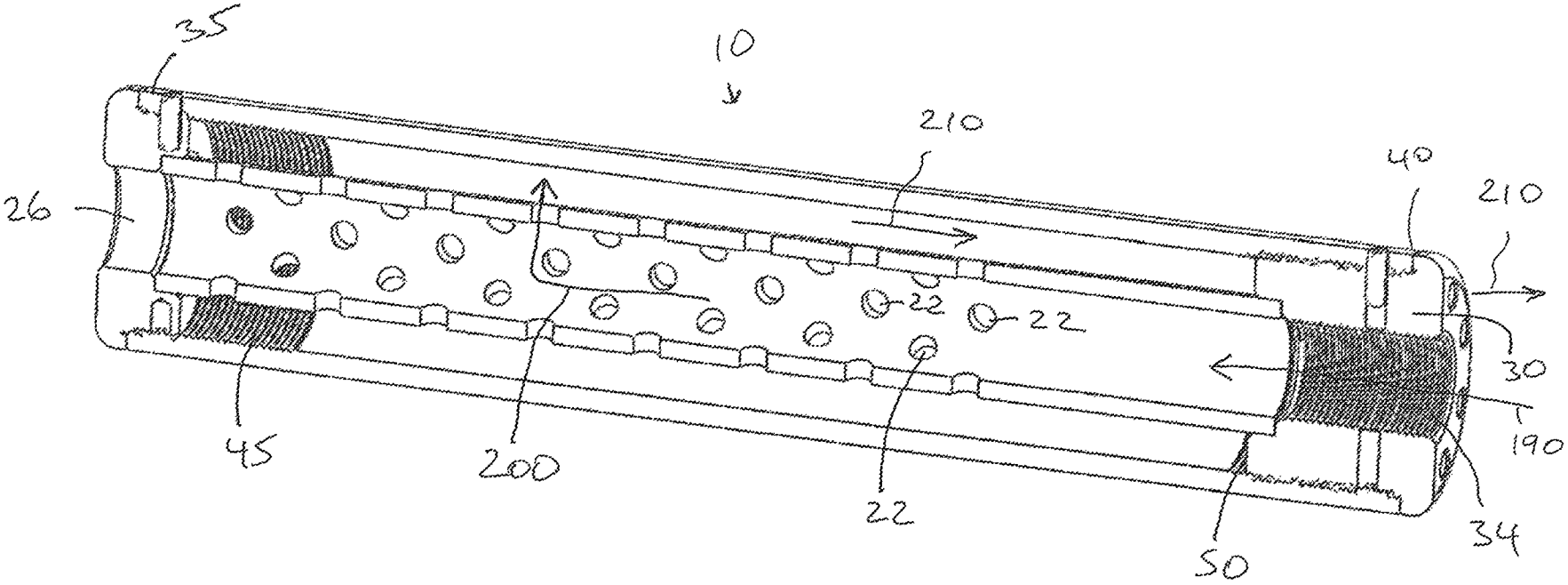
FIG. 3*a* depicts a cut away view of the expansion chamber assembly shown in FIG. 1*a*.
Figure 3B:
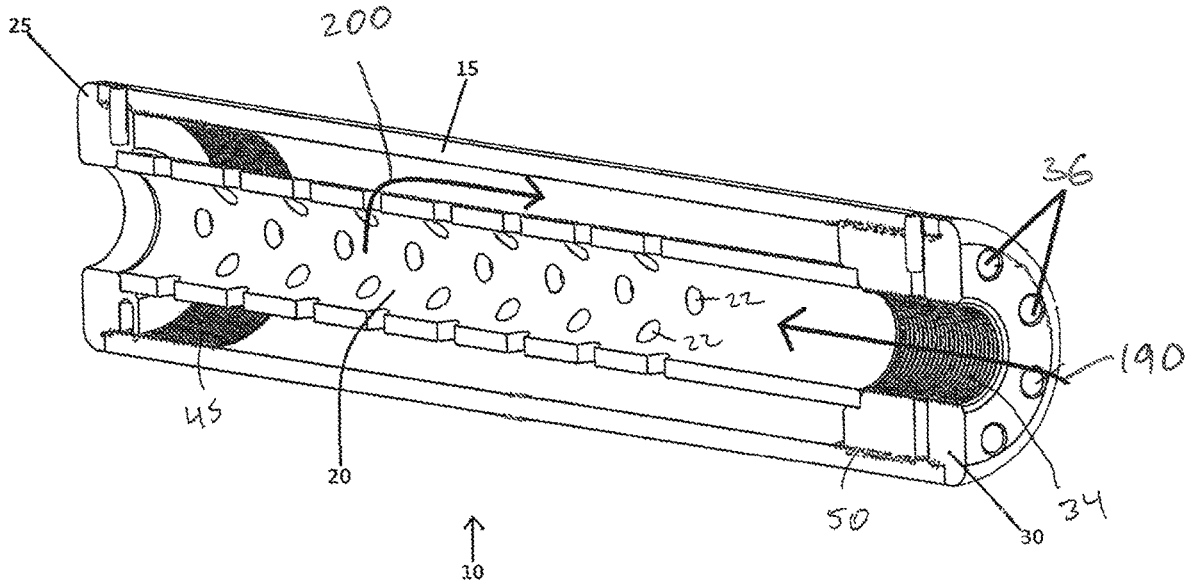
FIG. 3*b* depicts another cut away view of the expansion chamber assembly shown in FIG. 1*a*.

According to some embodiments, the inner tube 20 is retained inside the outer tube 15 with the front cap 25 and the rear cap 30 as shown in FIGS. 3*a-b*. According to some embodiments, the front cap 25 and/or the rear cap 30 are coupled with the outer tube 15. According to some embodiments, the front cap 25 and/or the rear cap 30 are removably coupled with the outer tube 15. According to some embodiments, the front cap 25 and/or the rear cap 30 are welded with the outer tube 15. According to some embodiments, the front cap 25 and/or the rear cap 30 are coupled with the outer tube 15 by one or more fasteners 75. According to some embodiments, the fasteners 75 are a pin, a screw, a set screw, a full dog point set screw, or a dogleg set screw.

Figure 3C:
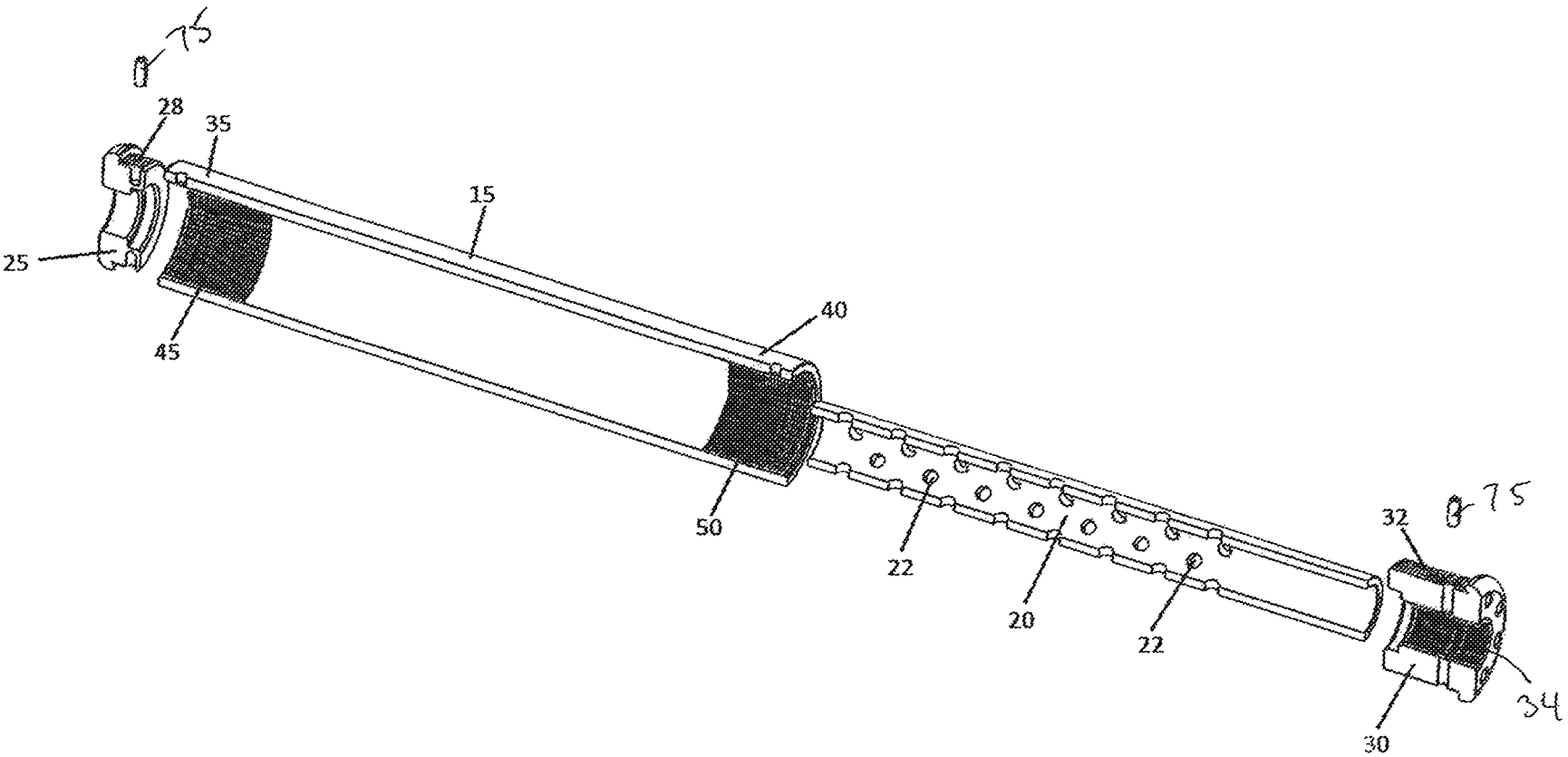
FIG. 3*c* depicts a cut away, exploded view of the expansion chamber assembly shown in FIG. 1*a*.
Figure 4A:
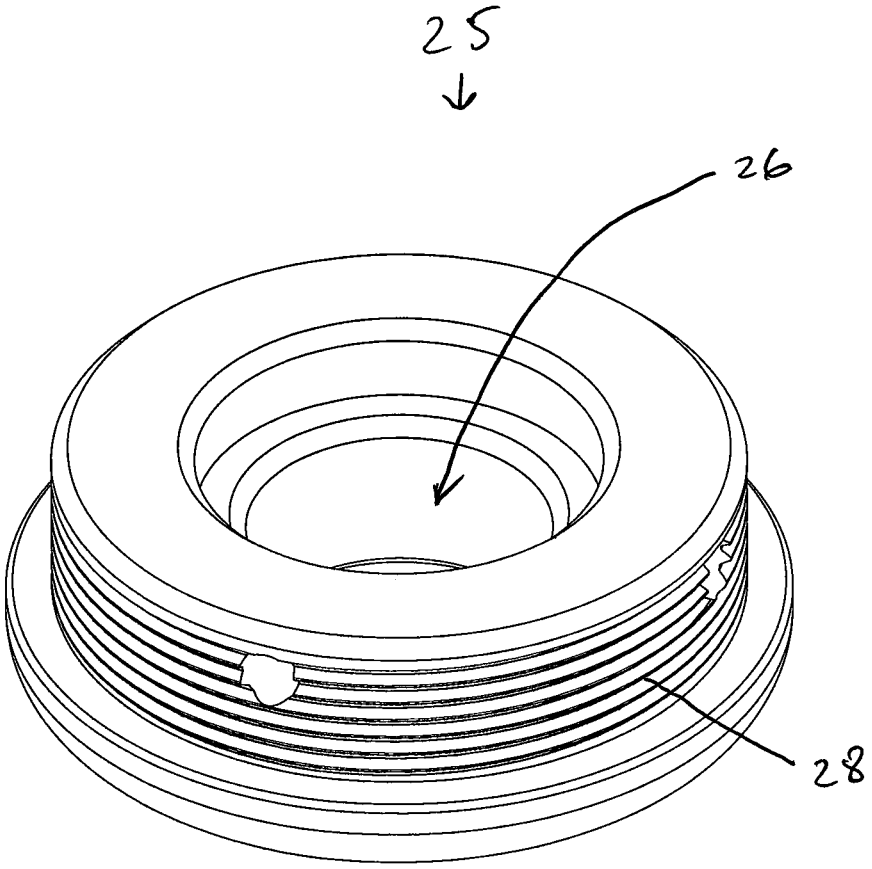
FIG. 4*a* depicts a perspective view of the front cap according to some embodiments presently disclosed.
Figure 4B:
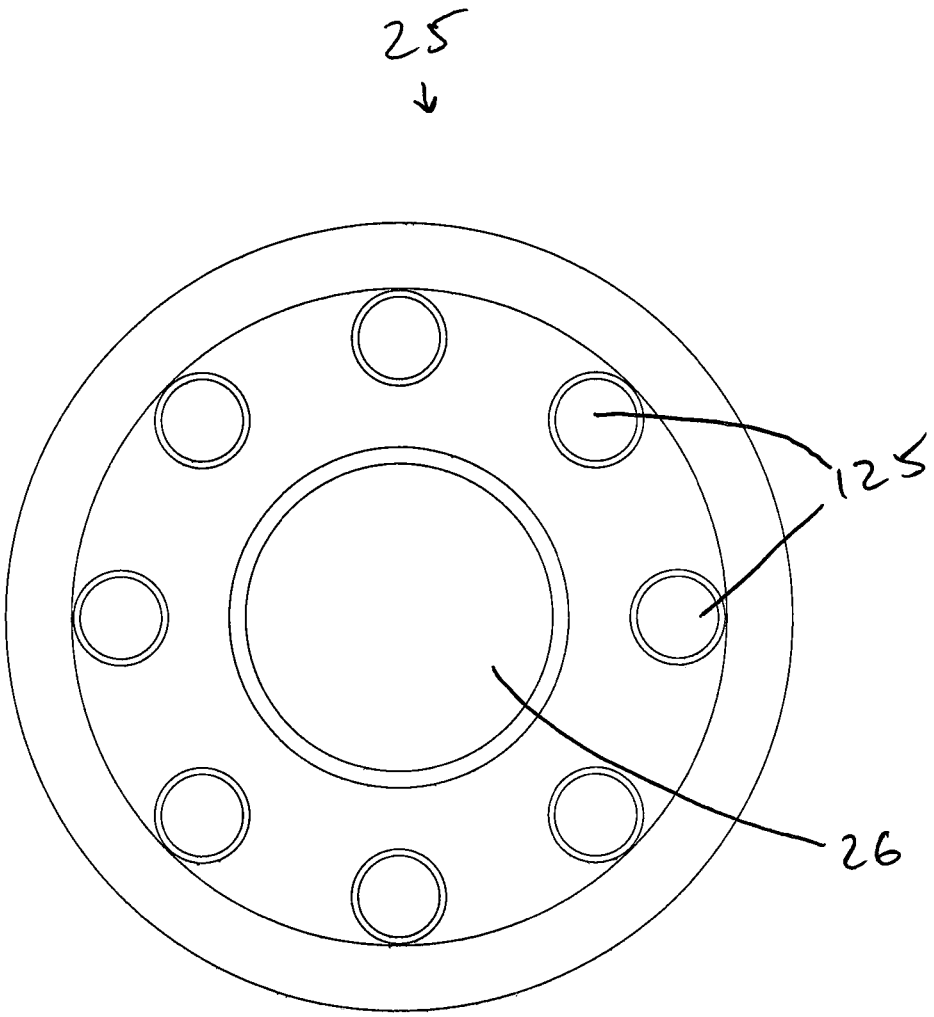
FIG. 4*b* depicts a top view of the front cap shown in FIG. 4*a*.
Figure 4C:
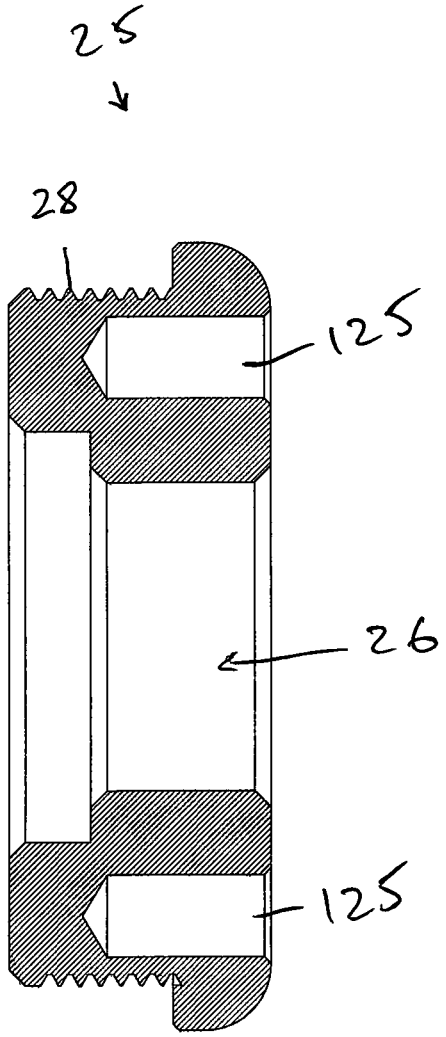
FIG. 4*c* depicts a side, cut away view of the front cap shown in FIG. 4*a*.
Figure 5A:
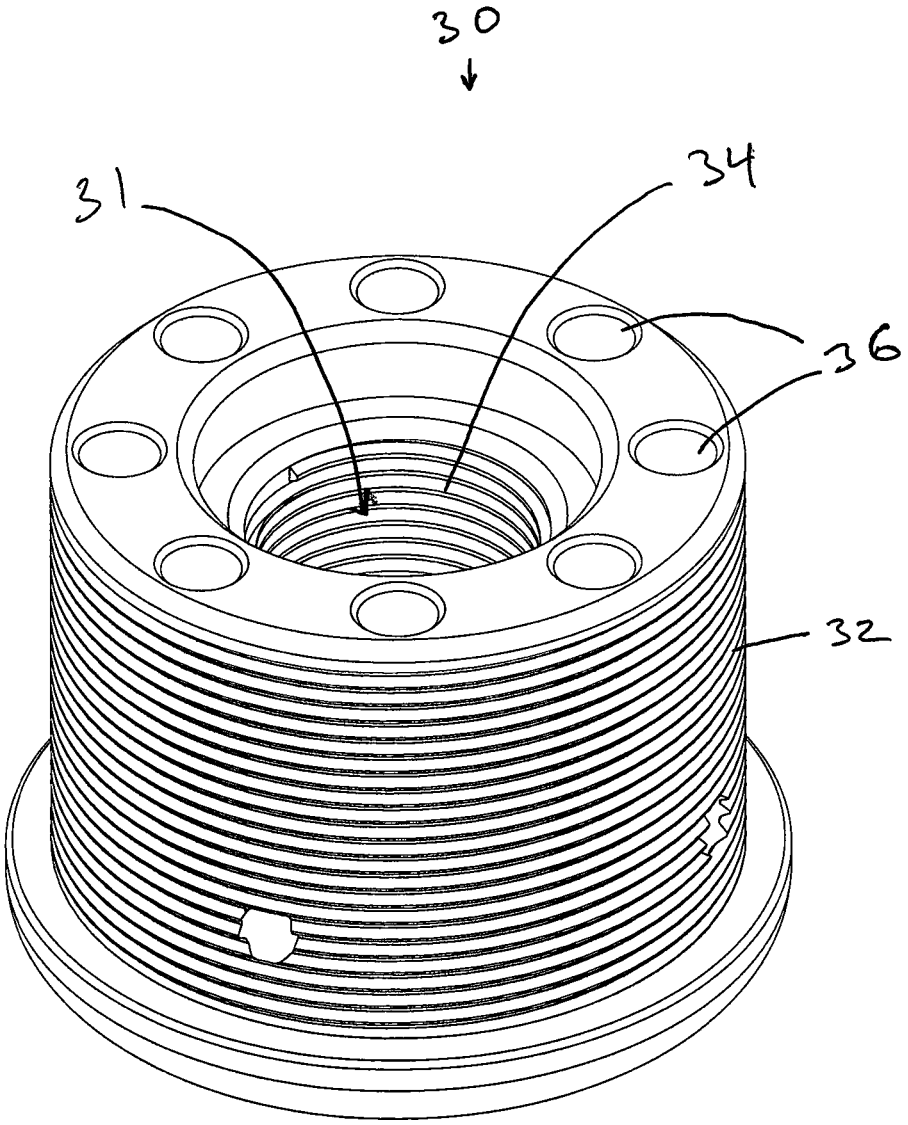
FIG. 5*a* depicts a perspective view of the rear cap according to some embodiments presently disclosed.
Figure 5B:
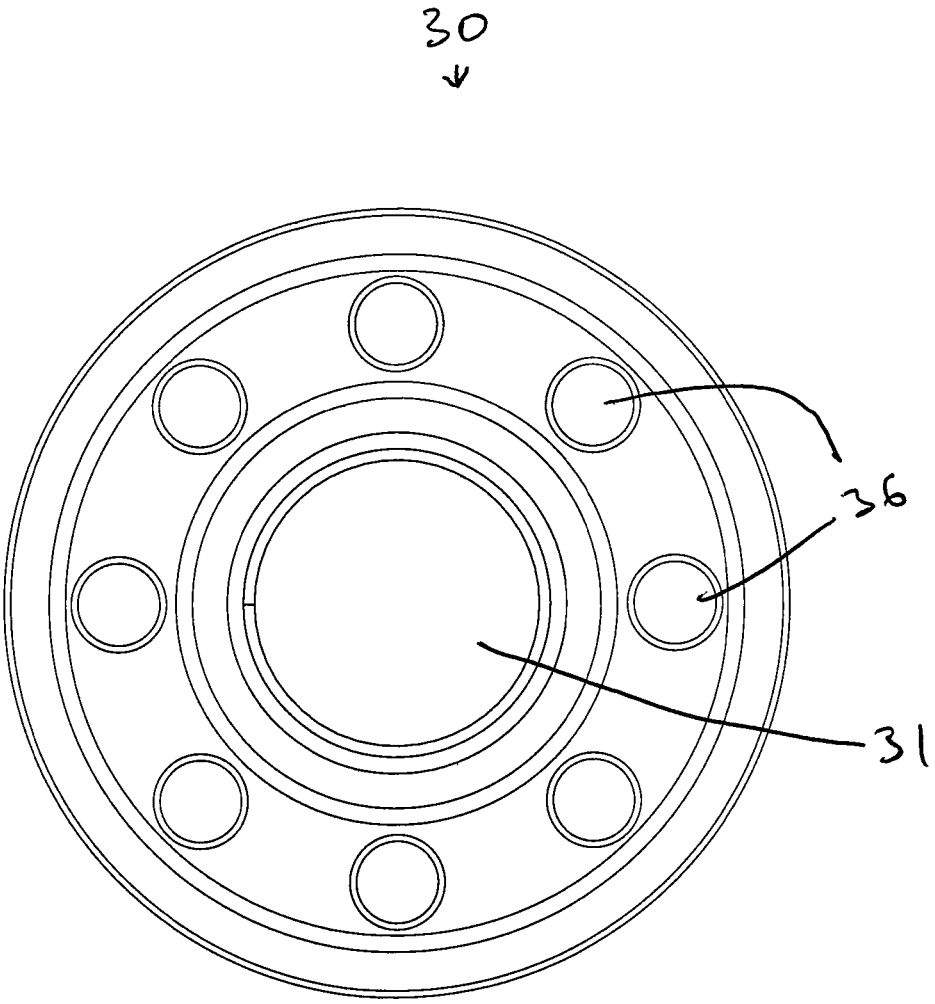
FIG. 5*b* depicts a top view of the rear cap shown in FIG. 5*a*.
Figure 5C:
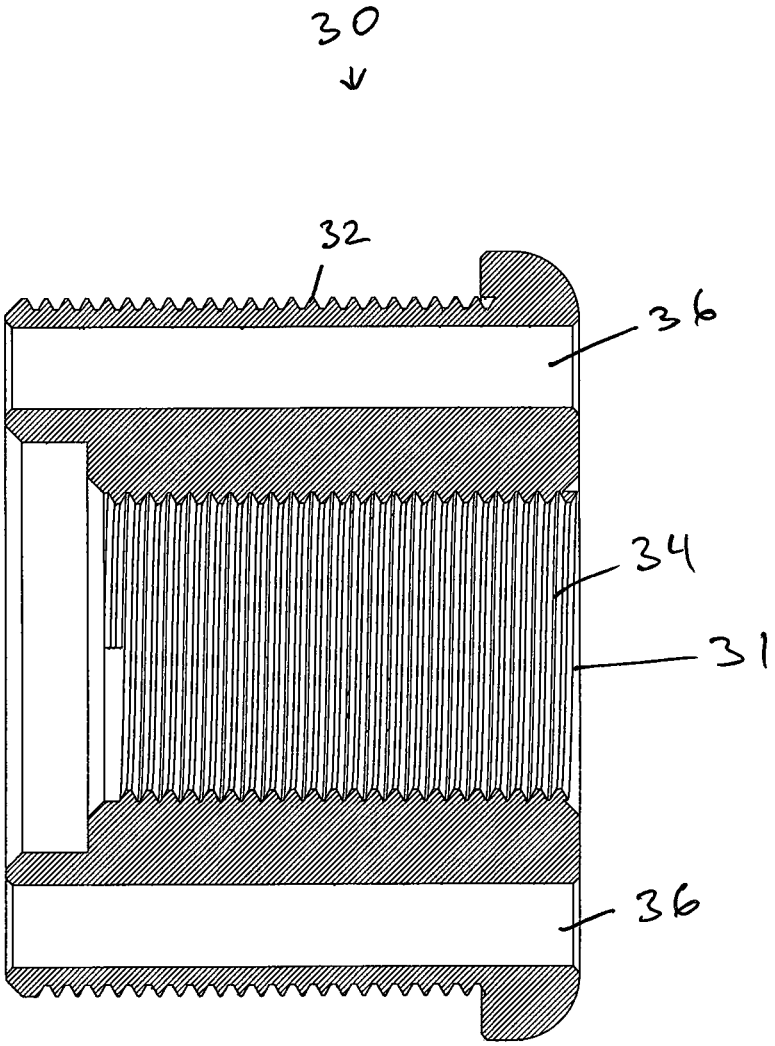
FIG. 5*c* depicts a side, cut away view of the rear cap shown in FIG. 5*a*.

According to some embodiments, the front cap 25 comprises a through aperture 26 (as shown in FIGS. 4*a-c*) and an outer thread 28 (as shown in FIGS. 4*a* and 4*c*). According to some embodiments, the rear cap 30 comprises a through aperture 31 (as shown in FIGS. 5*a-c*) and an outer thread 32 (as shown in FIGS. 5*a* and 5*c*). According to some embodiments, the outer tube 15 comprises a front end 35 and a rear end 40 (shown in FIG. 1*b*). The front end 35 may comprise an inner screw threads 45 (shown in cutaway FIGS. 3*a-c*) configured to accommodate and/or engage the outer thread 28 of the front cap 25. The rear end 40 may comprise an inner screw threads 50 (shown in cutaway FIGS. 3*a-c*) configured to accommodate and/or engage the outer thread 32 of the rear cap 30. According to some embodiments, the inner tube 20 is retained inside the outer tube 15 by screwing the front cap 25 in the front end 35 and screwing the rear cap 30 in the rear end 40. According to some embodiments, the inner tube 20 is sandwiched inside the outer tube 15 between the front cap 25 and the rear cap 30.

According to some embodiments, the front cap 25 comprises a through aperture 26 (as shown in FIGS. 4*a-c*) with an inner thread (not shown). According to some embodiments, the rear cap 30 comprises a through aperture 31 (as shown in FIGS. 5*a-c*) with an inner thread (not shown). According to some embodiments, the outer tube 15 comprises a front end 35 and a rear end 40 (shown in FIG. 1*b*). The front end 35 may comprise an outer screw threads (not shown) configured to accommodate and/or engage the inner thread of the front cap 25. The rear end 40 may comprise an outer screw threads (not shown) configured to accommodate and/or engage the inner thread of the rear cap 30. According to some embodiments, the inner tube 20 is sandwiched inside the outer tube 15 between the front cap 25 and the rear cap 30.

According to some embodiments, at least a portion of the through aperture 31 of the rear cap 30 comprises an inner thread 34 (shown in FIGS. 5*a* and 5*c*) configured to accommodate and/or engage at least a portion of an outer thread 71 (shown in FIG. 12*a*) on the exit end of the barrel 70. According to some embodiments, the entire through aperture 31 of the rear cap 30 comprises an inner thread 34 (shown in FIGS. 5*a* and 5*c*) configured to accommodate at least a portion of an outer thread 71 (shown in FIG. 12*a*) on the exit end of the barrel 70.

According to some embodiments, a bullet, fired from a firearm, travels through the firearm's barrel 70, through the aperture 31, through the inner tube 20, and through the aperture 26 of the expansion chamber assembly 10. Similar to the bullet, the expanding gasses formed by the firing of the bullet also travel through the firearm's barrel 70 and into the expansion chamber assembly 10 as shown by arrow 190 in FIGS. 3*a-b*.

According to some embodiments, at least a portion of the expanding gasses exit with the bullet through the aperture 26 of the front cap 25 of the expansion chamber assembly 10. According to some embodiments, the inner tube 20 comprises one or more through apertures 22 to allow at least another portion of the expanding gasses to enter the outer tube 15 as shown by the arrow 200 in FIGS. 3*a-b*. According to some embodiments, the through apertures 22 are round, rectangular, oval, circular or any other geometric shape.

According to some embodiments, the expanding gasses located between the outer tube 15 and the inner tube 20 may exit the expansion chamber assembly 10 through one or more exit through apertures (not shown) in the outer tube 15. According to some embodiments, the expanding gasses located between the outer tube 15 and the inner tube 20 may exit the expansion chamber assembly 10 through one or more exit through apertures 36 in the rear cap 30 as shown by arrow 210 in FIG. 3*a*. According to some embodiments, the expanding gasses located between the outer tube 15 and the inner tube 20 may exit the expansion chamber assembly 10 through one or more exit apertures (not shown) in the front cap 25. According to some embodiments, one or more exit through apertures 36 are in communication with the space between the outer tube 15 and the inner tube 20.

Figure 6A:
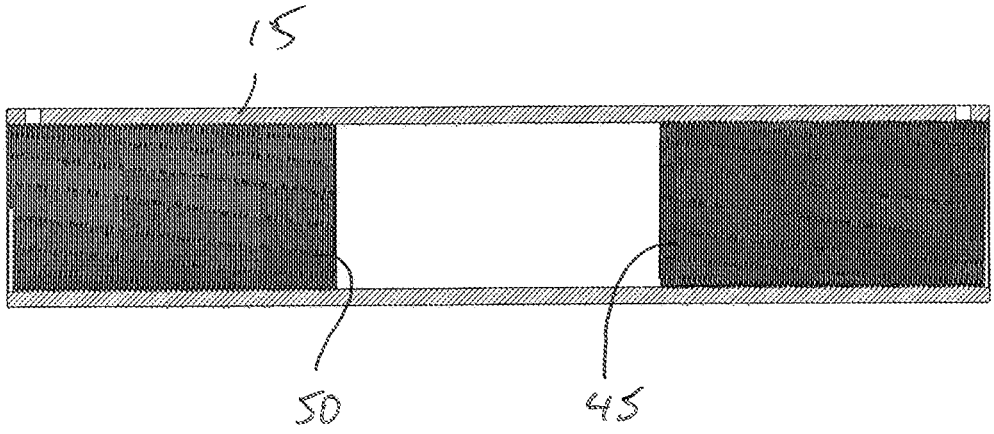
FIG. 6*a* depicts a side, cut away view of the outer tube according to some embodiments presently disclosed.
Figure 6B:
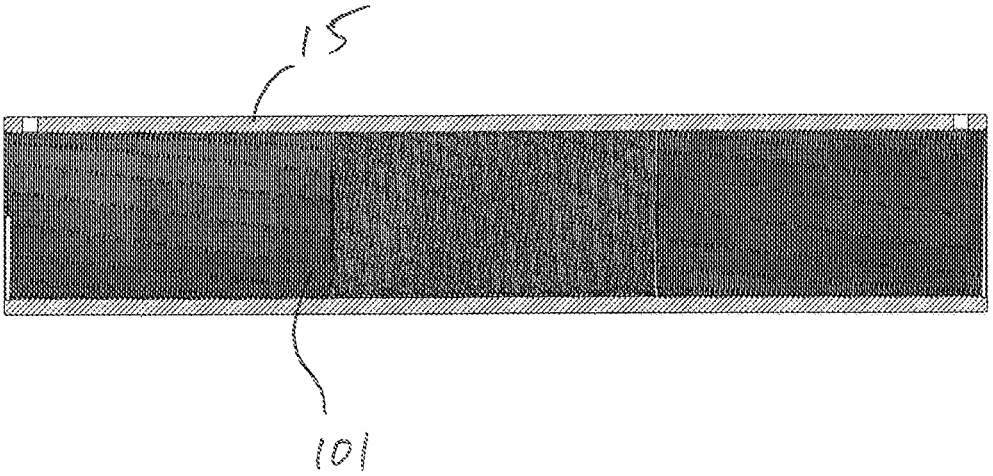
FIG. 6*b* depicts another side, cut away view of the outer tube according to some embodiments presently disclosed.
Figure 7A:
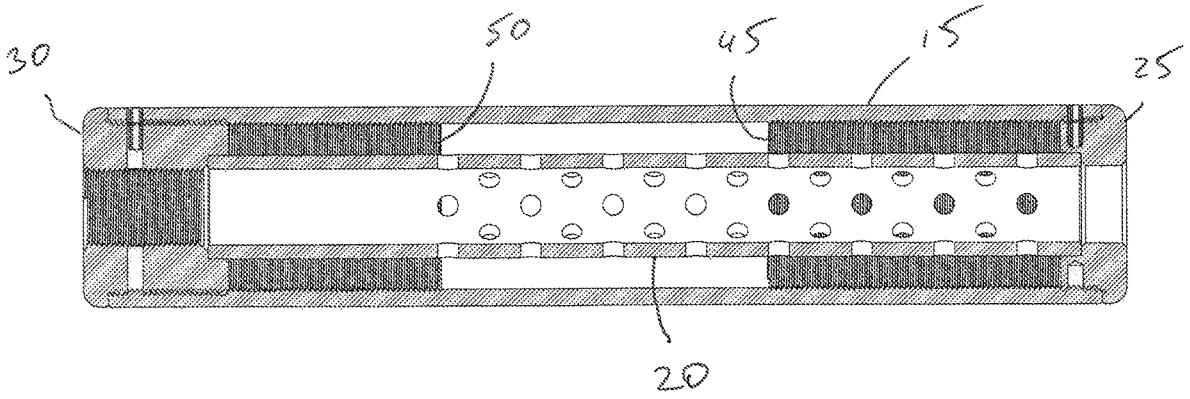
FIG. 7*a* depicts a side, cut away view of the expansion chamber assembly according to some embodiments presently disclosed.
Figure 7B:
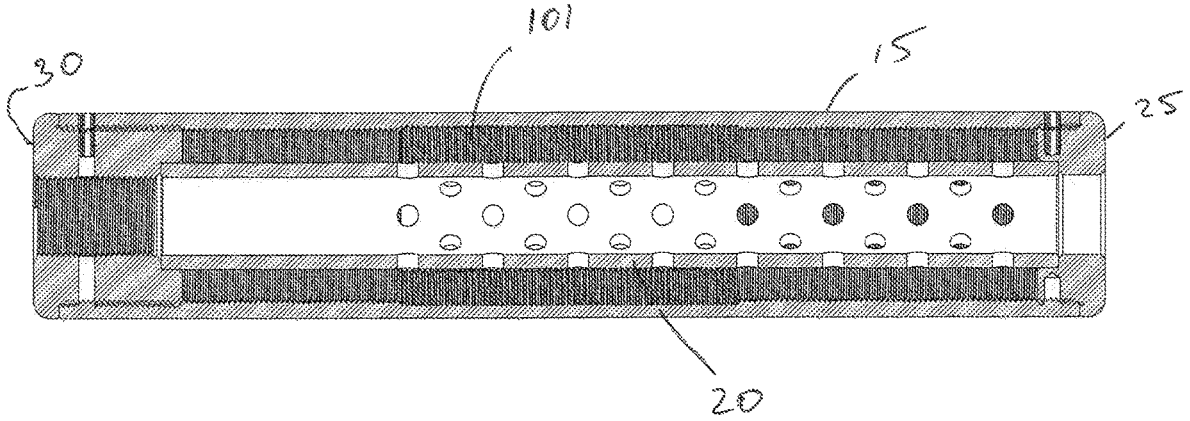
FIG. 7*b* depicts another side, cut away view of the expansion chamber assembly according to some embodiments presently disclosed.

According to some embodiments, the inner screw threads 45 extend into the outer tube 15 (as shown in FIGS. 6*a* and 7*a*) and are positioned to interact with the expanding gasses located between the outer tube 15 and the inner tube 20. According to some embodiments, the inner screw threads 50 extend into the outer tube 15 (as shown in FIGS. 6*a* and 7*a*) and are positioned to interact with the expanding gasses located between the outer tube 15 and the inner tube 20. According to some embodiments, the inner screw threads 45 and the inner screw thread 50 are the same inner screw thread 101 that spans the entire length of the outer tube 15 (as shown in FIGS. 6*b* and 7*b*) and positioned to interact with the expanding gasses located between the outer tube 15 and the inner tube 20. According to some embodiments, the inner screw threads 45, the inner screw threads 50 and/or the inner screw threads 101 are positioned to interact with the expanding gasses located between the outer tube 15 and the inner tube 20 and configured to minimize the sound generated by the bullet fired from the firearm.

According to some embodiments, the expansion chamber assembly 10 reduces recoil of the firearm by allowing a portion of the expanding gasses to exit through the apertures 36 located in the rear cap 30. According to some embodiments, the expansion chamber assembly 10 reduces recoil of the firearm by allowing a portion of the expanding gases to exit the expansion chamber assembly 10 in a direction opposite a direction of travel of the bullet being fired from the firearm.

According to some embodiments, the through apertures 36 are 0.125 inches in diameter. According to some embodiments, the through apertures 36 are round, rectangular, oval, circular or any other geometric shape. According to some embodiments, the rear cap 30 comprises eight (8) through apertures 36. According to some embodiments, the rear cap 30 comprises eight (8) through apertures 36 evenly spaced around the perimeter of the rear cap 30. According to some embodiments, the through apertures 36 are evenly spaced around the perimeter of the rear cap 30.

According to some embodiments presently disclosed, the expansion chamber assembly 10 is configured to decelerate and cool at least a portion of the expanding gasses thereby reducing the noise and/or flash created when the bullet is fired from the firearm.

Figure 8A:
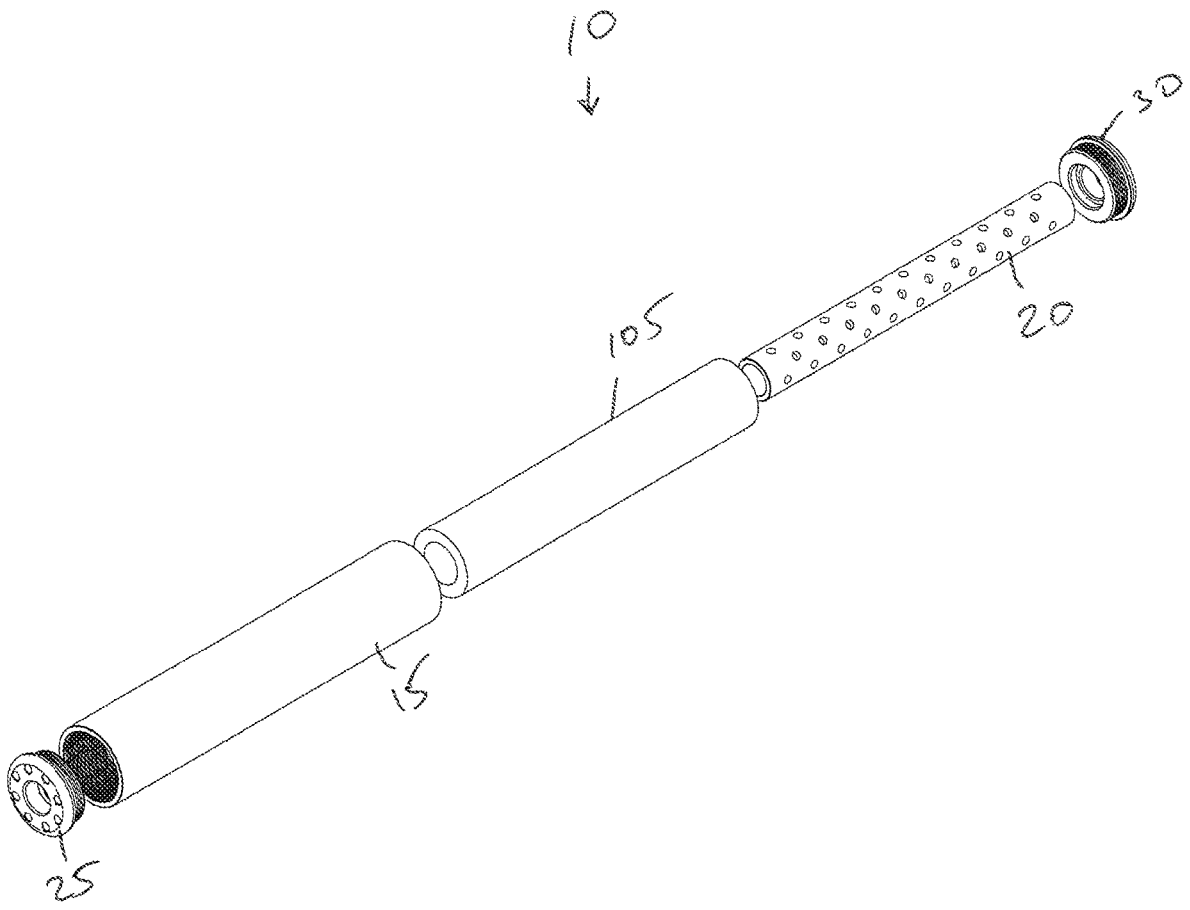
FIG. 8*a* depicts an exploded view of the expansion chamber assembly according to some embodiments presently disclosed.
Figure 8B:
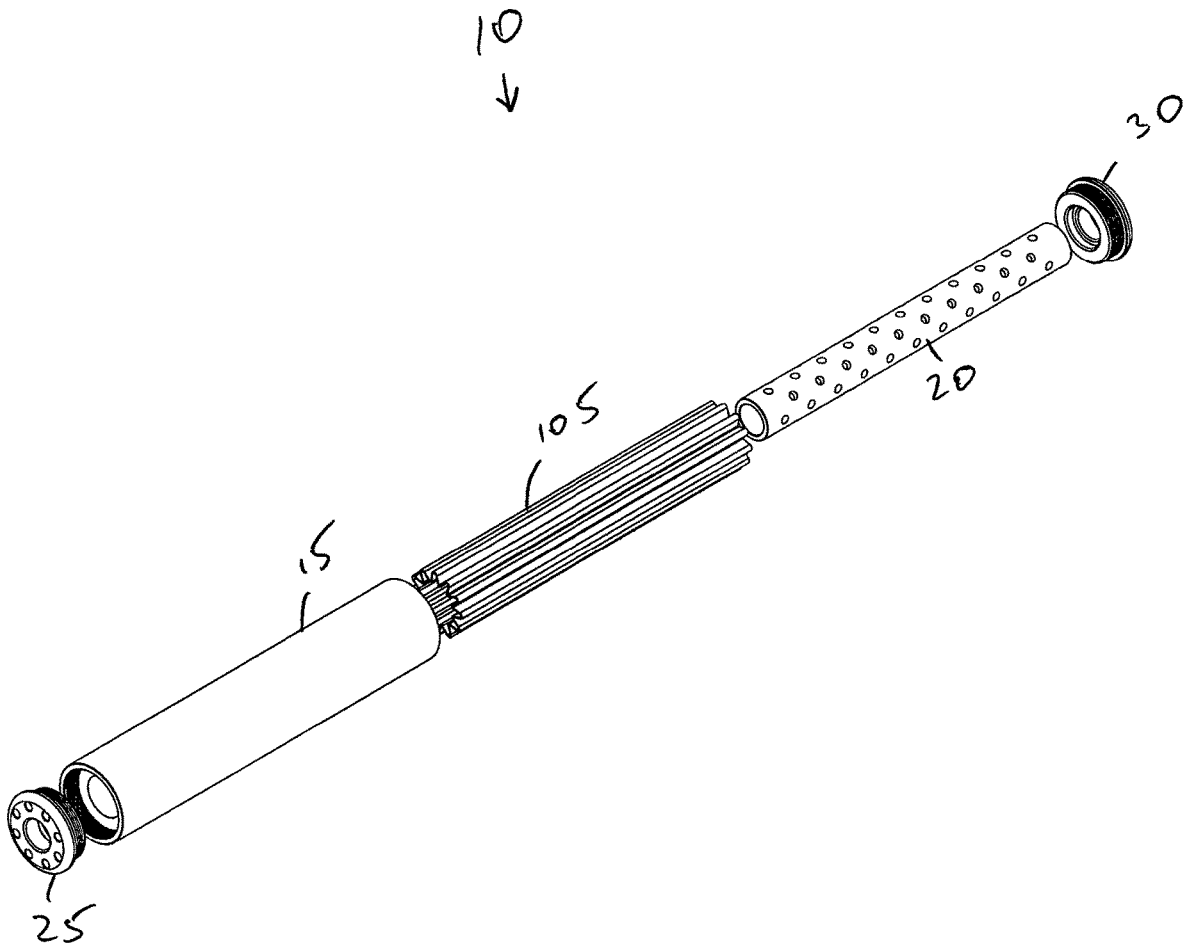
FIG. 8*b* depicts another exploded view of the expansion chamber assembly according to some embodiments presently disclosed.
Figure 9:
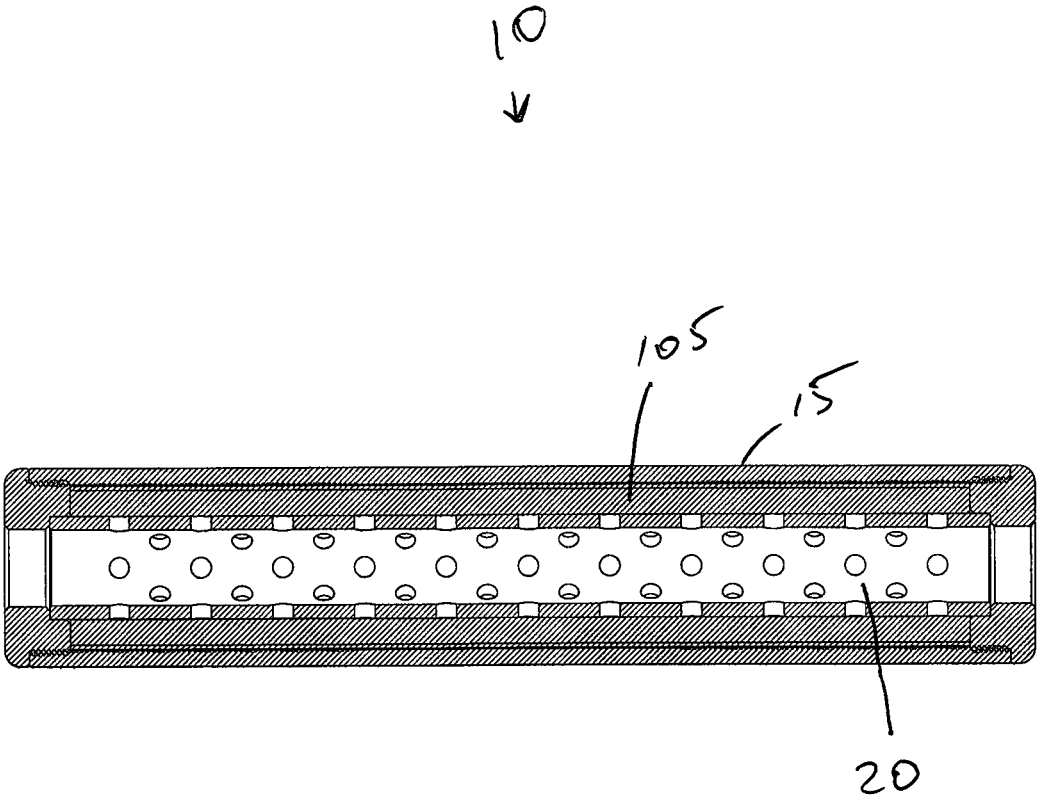
FIG. 9 depicts a side, cut away view of the expansion chamber assembly according to some embodiments presently disclosed.

According to some embodiments presently disclosed, the expansion chamber assembly 10 comprises one or more sound absorbing materials 105 (as shown in FIGS. 8*a-b*) configured to further reduce the noise created when the bullet is fired from the firearm. The sound absorbing materials 105 may be hollow cylinders wherein the outer tube 15 has a diameter sufficient to accommodate the sound absorbing materials 105 and the inner tube 20 (as shown in FIG. 9). The sound absorbing materials 105 may be hollow cylinders with a diameter sufficient to accommodate the inner tube 20 (as shown in FIG. 9).

Figure 10A:
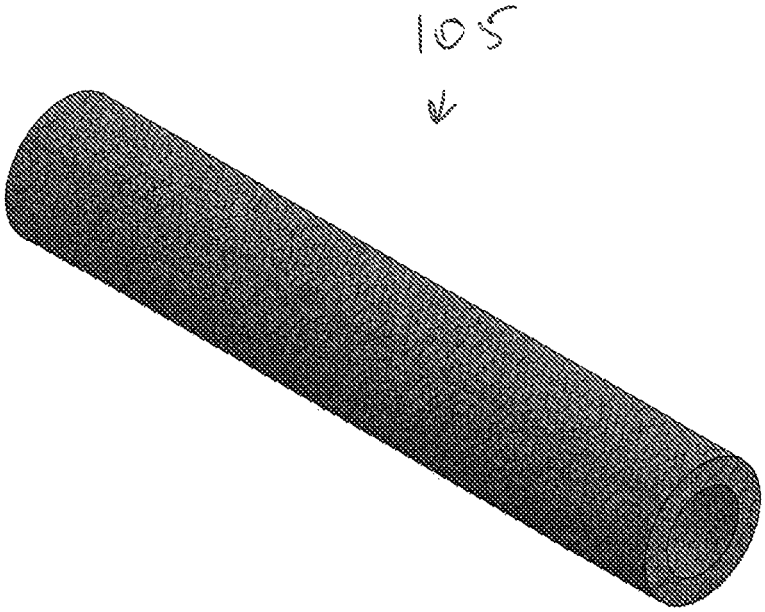
FIG. 10*a* depicts a perspective view of a sound absorbing material according to some embodiments presently disclosed.
Figure 10B:
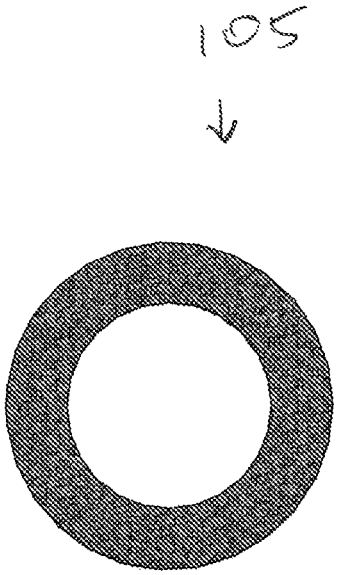
FIG. 10*b* depicts a front view of the sound absorbing material shown in FIG. 10*a*.
Figure 11A:
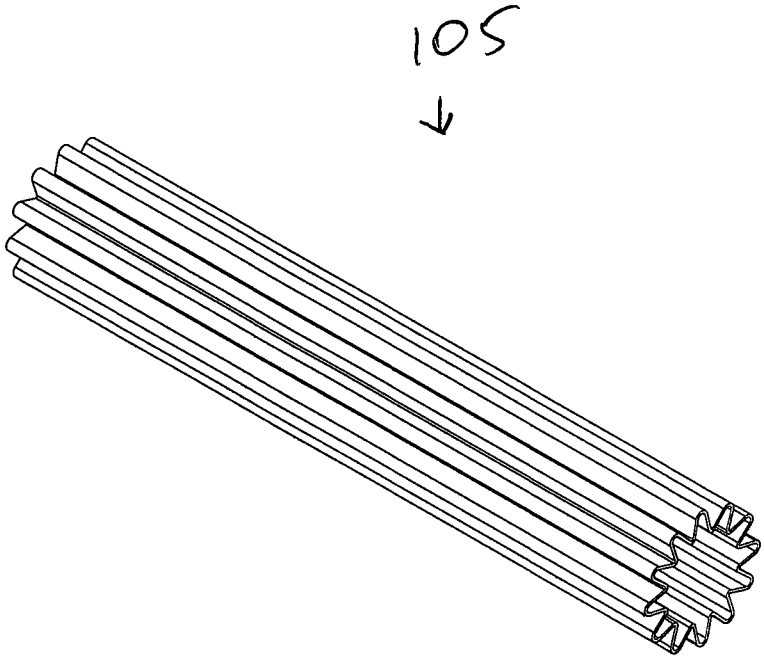
FIG. 11*a* depicts a perspective view of another sound absorbing material according to some embodiments presently disclosed.
Figure 11B:
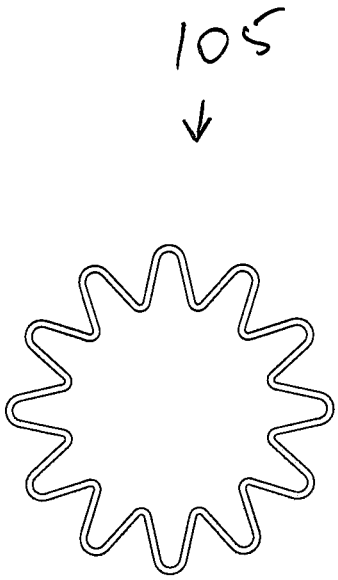
FIG. 11*b* depicts a front view of the sound absorbing material shown in FIG. 11*a*.

According to some embodiments presently disclosed, the absorbing materials 105 comprises a round cross section as shown in FIG. 10*a-b*. According to some embodiments presently disclosed, the sound absorbing materials 105 comprises a star shaped cross section as shown in FIG. 11*a-b*. According to some embodiments presently disclosed, the sound absorbing materials 105 is a flat, rectangular piece of material that can be rolled into a cylinder. According to some embodiments presently disclosed, the sound absorbing materials 105 is a flat, rectangular piece of material that can be rolled around the inner tube 20.

According to some embodiments presently disclosed, the sound absorbing materials 105 comprises muffler packing material, oil filter packing material, fiberglass material, steel mesh material, steel wool material, foam material, and/or any other type of sound reducing materials.

Figure 12A:
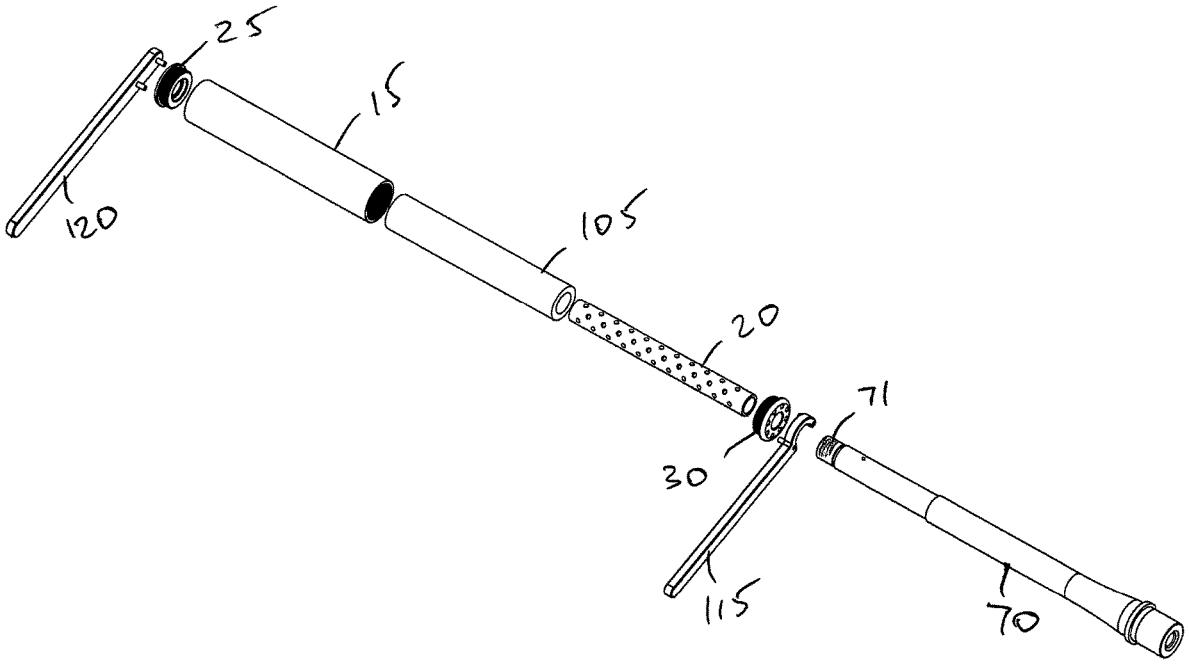
FIG. 12*a* depicts an exploded view of the expansion chamber assembly according to some embodiments presently disclosed.
Figure 12B:
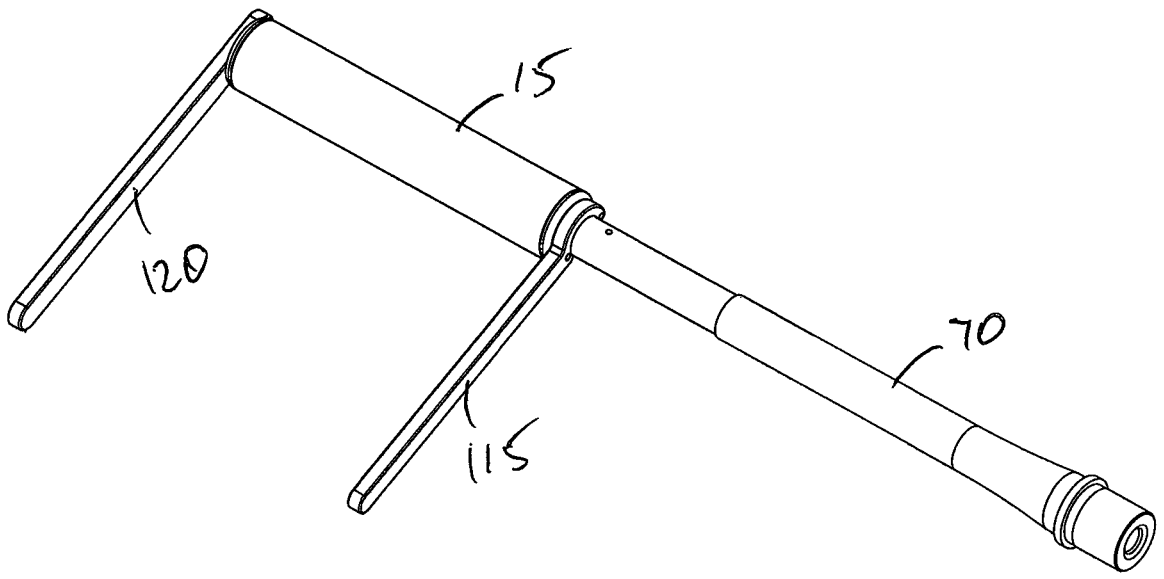
FIG. 12*b* depicts an assembled view of the expansion chamber shown in FIG. 12*a*.
Figure 13A:
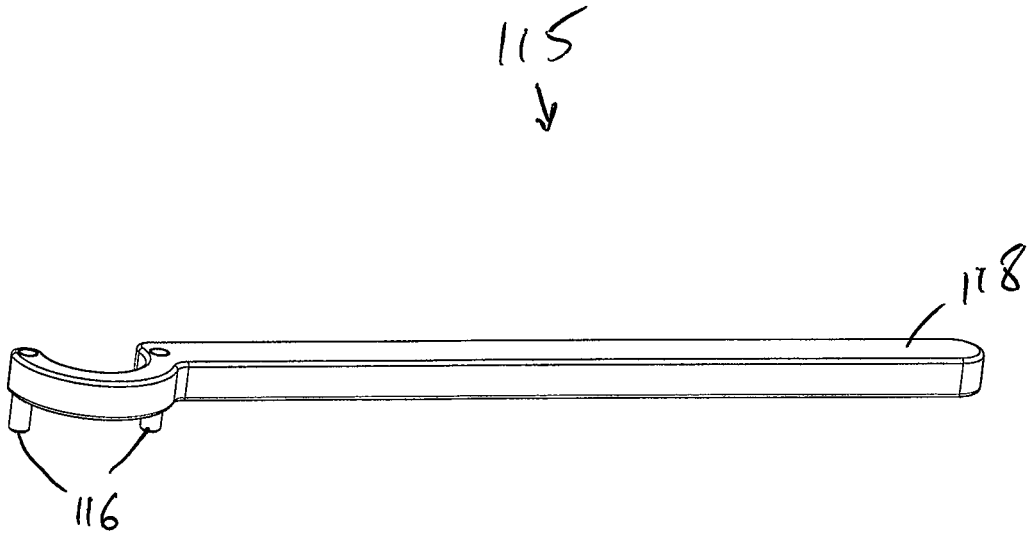
FIG. 13*a* depicts a perspective view of a tool according to some embodiments presently disclosed.
Figure 13B:
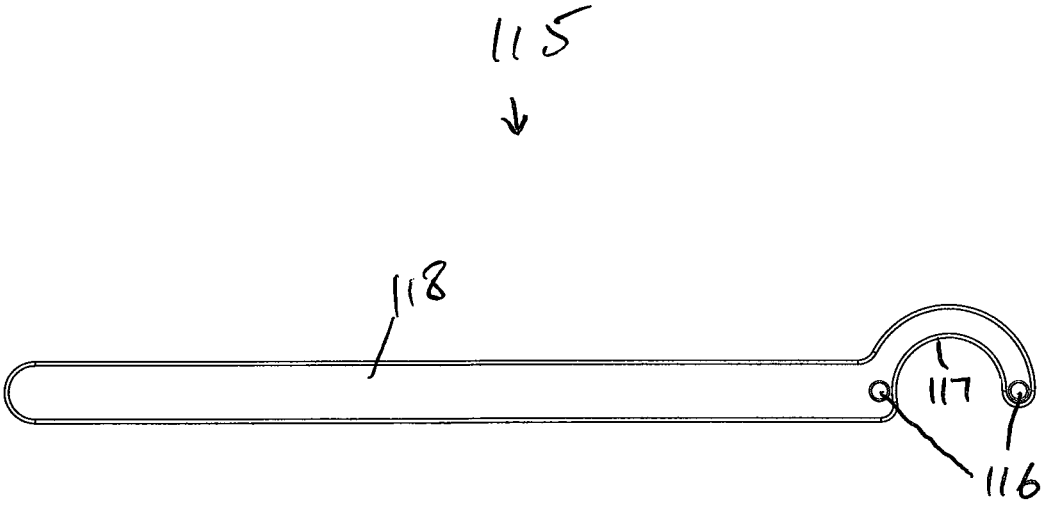
FIG. 13*b* depicts a top view of the tool shown in FIG. 13*a*.

Referring to FIGS. 12*a-b*, a tool 115 may be used to couple the rear cap 30 with the outer tube 15 and/or to couple the expansion chamber assembly 10 with the barrel 70. Referring to FIGS. 13*a-b*, the tool 115 comprises two or more protrusions 116 positioned and shaped to mate with two or more through apertures 36. The rear cap 30 may be coupled with the outer tube 15 by inserting the two or more protrusions 116 into the apertures 36 and rotating the rear cap 30 about the outer tube 15 so as to engage the inner screw threads 50 with the outer thread 32 of the rear cap 30. The rear cap 30 may be coupled with the barrel 70 by inserting the two or more protrusions 116 into the apertures 36 and rotating the rear cap 30 about the barrel 70 so as to engage the inner screw threads 34 of the rear cap 30 with the barrel 70's outer thread 71. According to some embodiments, the tool 115 comprises a substantially semi-circular portion 117 to accommodate the barrel 70. According to some embodiments, the tool 115 comprises a handle 118 to allow a user to operate the tool 115.

Figure 14A:
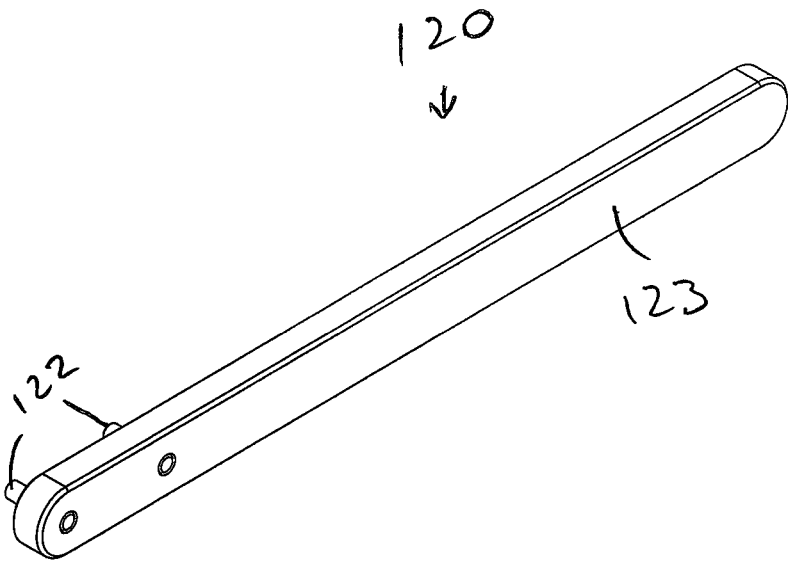
FIG. 14*a* depicts a perspective view of another tool according to some embodiments presently disclosed.
Figure 14B:
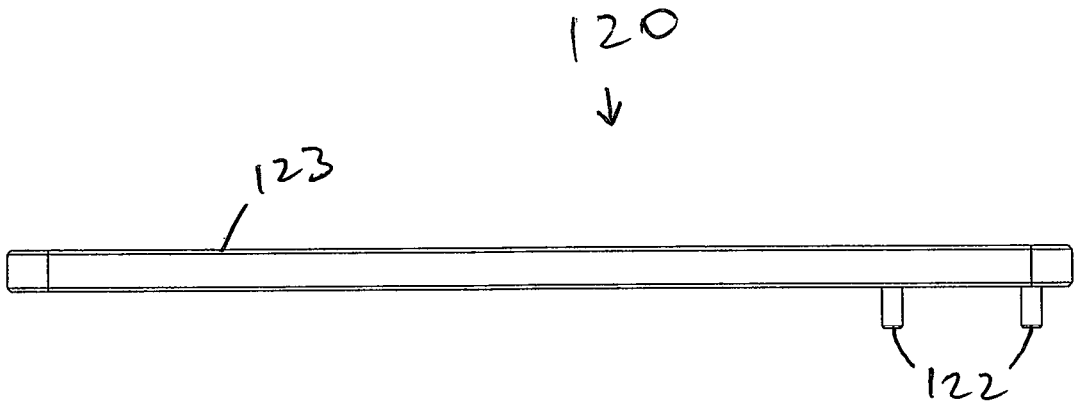
FIG. 14*b* depicts a side view of the tool shown in FIG. 14*a*.

Referring to FIGS. 12*a-b*, a tool 120 may be used to couple the front cap 25 with the outer tube 15. Referring to FIGS. 14*a-b*, the tool 120 comprises two or more protrusions 122 positioned and shaped to mate with two or more apertures 125 (shown in FIGS. 4*b-c*) in the front cap 25. The front cap 25 may be coupled with the outer tube 15 by inserting the two or more protrusions 122 into the apertures 125 and rotating the front cap 25 about the outer tube 15 so as to engage the inner screw threads 45 with the outer thread 28 of the front cap 25. According to some embodiments, the tool 120 comprises a handle 123 to allow a user to operate the tool 120.

According to some embodiments, the threads described above are continuous. According to some embodiments, the one or more threads described above are V-Thread, Square Thread, Buttress Thread, Reverse Buttress Thread or a combination of two or more of these threads.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A expansion chamber assembly for a firearm, the expansion chamber assembly comprising:
   - an outer tube comprising a front end and a rear end;
   - a front cap coupled with the outer tube at the front end;
   - a rear cap coupled with the outer tube at the rear end; and
   - an inner tube retained within the outer tube by the front cap and the rear cap, wherein the inner tube comprises one or more through apertures to allow a portion of expanding gasses to move from the inner tube into the outer tube;
   - wherein the portion of expanding gases move from the inner tube into the outer tube through the one or more through apertures;
   - wherein the portion of expanding gasses move from the outer tube to outside the expansion chamber assembly directly through one or more exit apertures located in the rear cap.

2. The expansion chamber assembly of claim 1 further comprising a sound absorbing materials positioned between the inner tube and the outer tube.

3. The expansion chamber assembly of claim 1, wherein the rear cap comprises an inner thread configured to engage an outer thread of a barrel.

* * * * *